United States Patent [19]

Ota

[11] 4,173,044

[45] Nov. 6, 1979

[54] DRAIN VALVE OPERATING DEVICE FOR A CISTERN OF FLUSH TOILET

[76] Inventor: Etsuji Ota, 20-Banchi, 4-chome, Shinmachi-dori, Nishi-ku, Osaka, Japan

[21] Appl. No.: 883,998

[22] Filed: Mar. 6, 1978

[30] Foreign Application Priority Data

Mar. 7, 1977 [JP] Japan ..... 52-27183

[51] Int. Cl.[2] ..... E03D 1/14; E03D 3/12

[52] U.S. Cl. ..... 4/325; 4/249; 4/412; 4/415

[58] Field of Search ..... 4/325, 412, 415, 249, 4/324, 405, 411

[56] References Cited

U.S. PATENT DOCUMENTS

| | | | |
|---|---|---|---|
| 3,036,313 | 5/1962 | Jenkins | 4/324 |
| 3,421,161 | 1/1969 | Stafford et al. | 4/325 |
| 3,932,900 | 1/1976 | Huston et al. | 4/415 |

*Primary Examiner*—Lenard A. Footland

*Attorney, Agent, or Firm*—Wenderoth, Lind & Ponack

[57] ABSTRACT

A drain valve operating device for a cistern of flush toilet whereby the amount of water for flushing a toilet pot can be available either in "large" amount or in "small" amount by turning a lever either to the right or to the left.

1 Claim, 3 Drawing Figures

DRAIN VALVE OPERATING DEVICE FOR A CISTERN OF FLUSH TOILET

BACKGROUND AND SUMMARY OF THE INVENTION

This invention relates to a drain valve operating device for a cistern of a flush toilet, more particularly, to a lever which controls the opening and shutting of a drain valve of a cistern for flushing a toilet pot. The purpose of the present invention is to allow a choice between flushing a large amount or a small amount of water by turning a lever in either the right or the left direction. Change-over can be effected accurately, and also, the return of the lever to its original position is ensured after operation.

With conventional flush toilets, a change-over lever which controls the draining amount is attached to the cistern for the purpose of adjusting the flushing amount of water according to the nature of evacuation, namely, urine or feces. By operating the lever, the drain valve is opened or shut with the aid of a chain. However, regardless of the direction in which the lever is turned, the degree of opening of the drain valve is constant because the drain valve and the lever joined to the chain are perpendicularly set. Under this arrangement, the amount of flushing water is changed by adjusting the operation angle of the lever. For carrying out this adjustment of the operation angle, notches are made both on a spindle fixing the lever and on a spindle support metal. Through contact of these notched parts, the angle of the lever is regulated in connection with the movement of the lever, namely, according to the direction in which the lever is turned, whereby the lifting degree of the drain valve is adjusted. Thus, in the case of the conventional flush toilet, a great deal of labor is required to assemble such a drain valve operation device which is complicated in structure. There is a resultant higher manufacturing cost.

In view of the above-mentioned disadvantage of the conventional flush toilet, the present invention contemplates to provide a drain valve operating device for a flush toilet which is simple in structure and yet accurate in operation.

BRIEF DESCRIPTION OF THE DRAWINGS

The present invention will be understood more clearly from the following description made with reference to an embodiment shown in the accompanying drawing, in which.

DETAILED DESCRIPTION OF THE INVENTION

Figure 1:
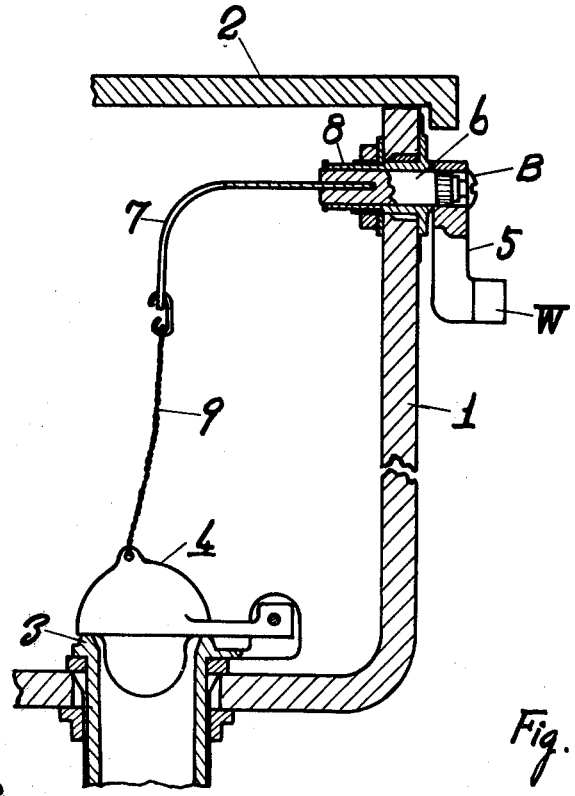
FIG. 1 is a cross section of a part of the cistern in which a drain valve operating device according to the present invention is arranged.

In the drawing, a tank body 1 has the required water holding capacity for flushing. The tank body is open at its upper part, where a lid 2 is set detachably. The tank body 1 and the lid 2 are usually manufactured of earthenware but can be made of synthetic resin or other watertight materials. At the bottom of the tank body 1 is a drainage opening 3 at which a drainpipe leading to the toilet pot is connected. A drain valve 4 which can be opened or shut and which is adjustable in the degree of angle at which it is opened is provided at the drainage opening 3, whereby the drainage opening 3 is blocked while the drain valve 4 is shut or rests on the drainage opening 3 but is open when the drain valve 4 is lifted. This system is already known.

At the upper part of one side face of the tank body 1 at convenient location is a pivotable operating lever 5. This lever 5 is fitted an the outer end of a spindle 6 which passes through the upper part of one of the side walls of the tank body 1 in such a fashion that the fitting angle is freely adjustable; for example, while an end portion of the spindle is cut into the shape of a spline, a hole which can be fitted in the spline part is made at one end of the lever so that the lever can be fitted in the end of the spindle. Where necessary, a screw B may be used to fit the two. One end of an L-shaped operating rod 7 is fixed to the inner end of the spindle 6. This connection of the ends is effected by welding or, as indicated in the drawing, by locking the end of the L-shaped operating rod 7 in a groove made at the inner end of the spindle 6. In this arrangement, by operating the operating lever 5, the L-shaped operating rod 7 is turned with the spindle 6 as a pivot. A sleeve 8 may be provided between the outer circumference of the spindle 6 and the inner surface of a hole in the side wall of the tank body 1 so that the spindle 6 may turn easily and smoothly by the operation of the operating lever. In addition, the other end of the operating lever 5 or the free end of the lever is equipped with a weight W so that that end of the lever 5 may always be perpendicular or vertical, in consideration of the balance with the L-shaped operating lever 7. This weight also acts as a handle when the operating lever 5 is operated.

The inner end of the L-shaped operating rod 7 is coupled with one end of a chain 9, and the other end of the chain is joined to a part of the drain valve 4. The L-shaped operating rod 7 and the drain valve 4 are positioned in such a fashion that both are at a fixed angle to each other. Under this arrangement, by operating the operating lever 5 the opening and shuting actions of the drain valve 4 are effected through the spindle 6, the L-shaped operating rod 7 and the chain 9 which are connected to each other at the fixed angle to the side wall surface of the tank 1.

Figure 2:
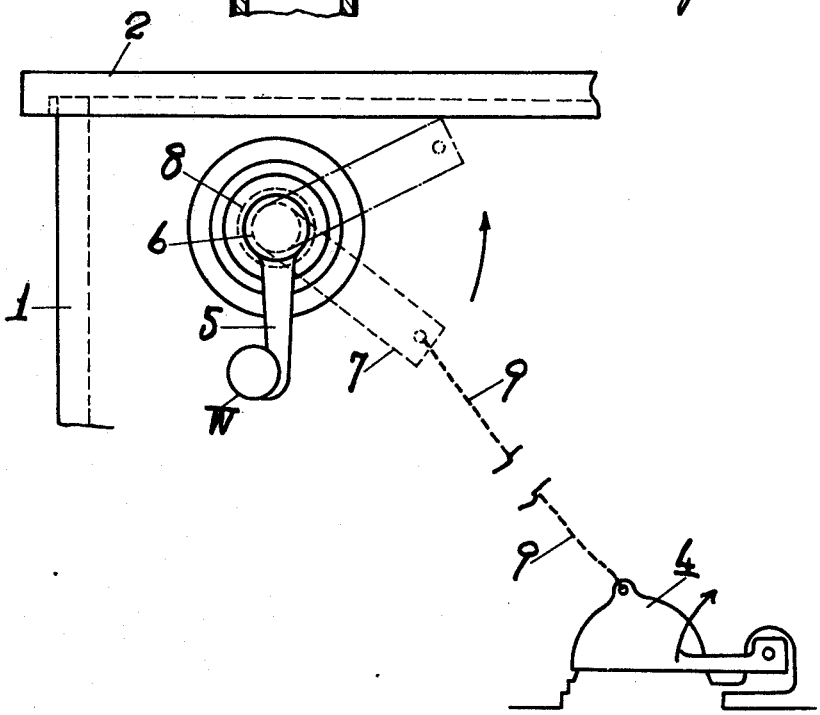
FIG. 2 is a front view of the cistern shown in FIG. 1.
Figure 3:
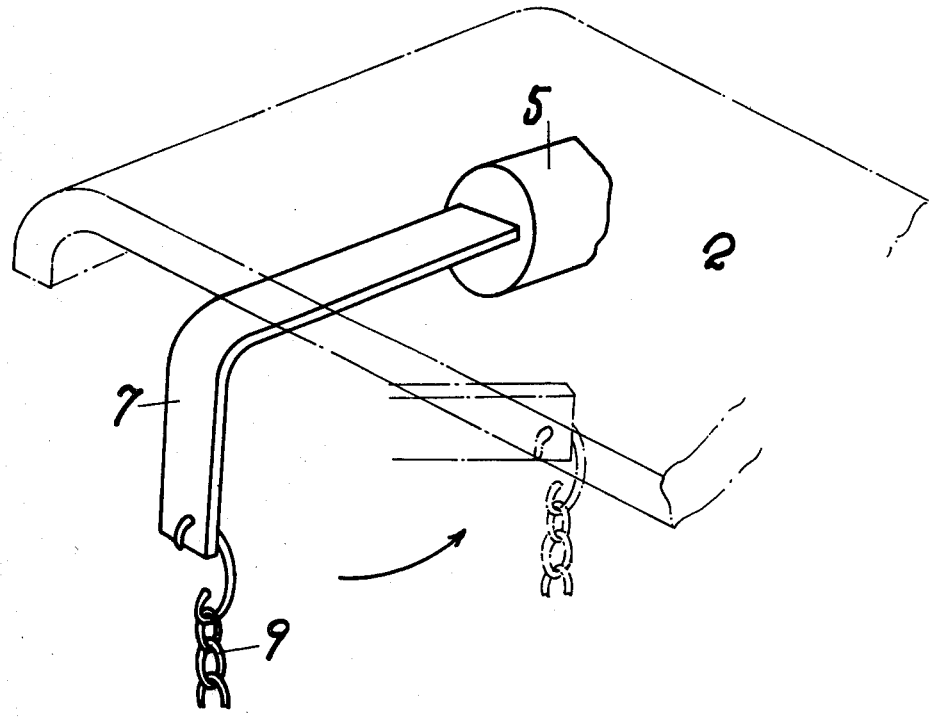
FIG. 3 is a perspective view of a L-shaped operating rod.

When the drain valve 4 is opened by the operation of the L-shaped operating rod 7, one side of the L-shaped operating rod 7 is made to come into contact with the inner surface of the lid 2 on the tank body 1, whereby the range within which the operating lever 5 connected to the L-shaped operating rod 7 is swingable is controlled and thus the degree of opening of the drain valve 4 is controlled to be "small" through the chain 9 connecting to one end of the L-shaped operating rod 7. When the L-shaped operating rod 7 comes into contact with the inner surface of the lid 2, the drain valve 4 is pulled by the chain 9 in the opening direction, presenting the most proper degree of opening (small) for flushing a small amount of water for the case of urine. The degree of opening is controlled so because the operating lever 5 may not swing any further due to the fact that one side of the L-shaped operating rod 7 makes contact with the inner surface of the lid 2. (A stopper may also be provided protrudingly to contact the L-shaped operating rod 7 and effect a similar function.) When the operating lever 5 is swung in the opposite direction, that is in a perpendicular position, the L-shaped operating rod 7 is in a position about 45° diverging rightward from the operating lever 5 as shown in FIG. 2 (this angle can be changed at one's option) and the chain 9 is in the most slackened state. If the operating lever 5 is moved leftward (clockwise), then the L-shaped operating rod 7 is slightly moved to the left from the perpendicular position and the chain 9 pulls the drain valve 4 in the transverse direction, whereupon the tension direction of the chain 9 in which the drain valve attains its maximum degree of opening previously determined for flushing feces (large) is made different from the opening direction of the drain valve 4, thereby regulating the opening width of the drain valve 4. In this case, even if an attempt is made to turn the operating lever 5 to the left any further, the operating lever 5 is not allowed to turn any further by the force of the chain 9 which is under full tension, and thus the degree of opening of the drain valve remains unchanged. When the operating lever 5 is released after operation, the operating lever 5 automatically returns to its original perpendicular position due to the weight W provided thereon, and thus the drain valve 4 is shut.

According to the present invention, the L-shaped operating rod which co-acts with the operating lever 5 is provided and it designed so that one side of the L-shaped operating rod makes contact with the inner surface of the lid and so that one of the tension directions of the chain which joins the said rod to the drain valve and the direction in which the drain valve opens and shuts are different from each other, whereby the degree of opening of the drain valve can be varied according to the direction in which the operating lever is turned and the degree of opening can be controlled easily.

What is claimed is:

1. A drain valve operating device for a cistern of a flush toilet which has a hollow tank body, a lid on the top of said body, and a drain in the bottom of said body, said device comprising:

a rotatable spindle means mounted through the sidewall of said tank body;

an operating lever means with a weight at its free end connected to said spindle outside of said tank body;

a drain valve over said drain for opening and closing said drain;

a chain connected at one end to said drain valve; and an L-shaped operating rod means connected at one end which is parallel to the axis of said spindle means, to said spindle inside said tank body and connected at its opposite end to said chain, said operating rod means being positioned near said lid so that rotating said spindle means in one direction causes said operating rod means to abutt said lid, and said lever means being rotatable away from the direction of contacting said lid so that said chain connected between said rod and said drain valve is pulled away from said drain valve at an angle different than the opening direction of said drain valve.

* * * * *